US005865615A

United States Patent [19]

Simpson et al.

[11] Patent Number: 5,865,615

[45] Date of Patent: Feb. 2, 1999

[54] SEALED BURNER

[75] Inventors: Anthony W. Simpson, Jacksboro; Gregory Zambeck, Caryville; Garry Wayne Woods, Heiskell, all of Tenn.

[73] Assignee: Lincoln Brass Works, Inc., Jacksboro, Tenn.

[21] Appl. No.: 799,602

[22] Filed: Feb. 12, 1997

[51] Int. Cl.[6] ..... F23Q 3/00

[52] U.S. Cl. ..... 431/266; 431/264; 126/39 R; 126/39 H; 239/567

[58] Field of Search ..... 126/39 R, 39 H, 126/39 N; 431/266, 264; 239/567, 559

[56] References Cited

U.S. PATENT DOCUMENTS

| | | | |
|---|---|---|---|
| 366,780 | 7/1887 | Love et al. | 239/559 |
| 2,486,278 | 10/1949 | Harper | 239/559 |
| 3,289,731 | 12/1966 | Geber . | |
| 4,518,346 | 5/1985 | Pistien . | |
| 4,565,523 | 1/1986 | Berkelder . | |
| 4,572,154 | 2/1986 | Schweitzer . | |
| 4,626,196 | 12/1986 | Stohrer, Jr. . | |
| 4,627,411 | 12/1986 | Mertler . | |
| 4,810,188 | 3/1989 | Kwiatek . | |
| 4,846,671 | 7/1989 | Kwiatek . | |
| 5,002,038 | 3/1991 | Riehl . | |
| 5,040,970 | 8/1991 | Riehl . | |
| 5,083,915 | 1/1992 | Riehl . | |
| 5,085,202 | 2/1992 | Riehl . | |
| 5,112,218 | 5/1992 | Sigler . | |
| 5,119,802 | 6/1992 | Cherry et al. . | |
| 5,125,390 | 6/1992 | Riehl . | |
| 5,133,334 | 7/1992 | Riehl . | |
| 5,139,417 | 8/1992 | Ghassemzadeh . | |
| 5,149,262 | 9/1992 | Riehl . | |
| 5,152,276 | 10/1992 | Brock et al. . | |
| 5,160,255 | 11/1992 | Sigler . | |
| 5,160,256 | 11/1992 | Riehl . | |
| 5,186,158 | 2/1993 | Ferlin . | |

*Primary Examiner*—Carroll Dority
*Attorney, Agent, or Firm*—Harness, Dickey & Pierce, P.L.C.

[57] ABSTRACT

A gas burner assembly has a sheet metal base section having a generally constant wall thickness and a sheet metal burner cap also having a generally constant wall thickness. The burner cap includes a plurality of burner ports and the burner cap is removably secured to the base section to define a gas chamber. The removability of the burner cap allows easy cleaning of the burner ports as well as the rest of the burner assembly. The base section is secured to the cook top by a twist lock arrangement which simplifies removal of the complete burner assembly without the need for tools when cleaning or maintenance is required.

27 Claims, 3 Drawing Sheets

SEALED BURNER

FIELD OF THE INVENTION

The present invention relates to sealed burners for gas ranges. More particularly, the present invention relates to a modular sealed gas burner which can be removed from the gas range without the use of tools in order to facilitate the cleaning of the gas range.

BACKGROUND AND SUMMARY OF THE INVENTION

Conventional gas ranges are generally comprised of a planar range top having a plurality of apertures within each of which is mounted a sealed gas burner. The sealed burners are secured in place within each aperture with the outer periphery of the sealed burner mating with the range top such that any spillage of food during the cooking process cannot pass between the sealed burner and the range top and into the burner box below the range top. This type of a burner is an improvement over prior art gas burners which were mounted to the gas supply system which is located within the burner box and thus required an annular spacing between the burner and the edge of the aperture in the range top to enable the removal of the range top for cleaning and/or repairs. The improved sealed burner assembly provides a clean streamlined appearance which facilitates both the cleaning and maintenance of the range top.

A typical prior art sealed burner assembly includes a die cast metal burner body which is covered with a removable die cast metal top to form a gas chamber. The burner body includes a side wall having a plurality of burner ports formed therein and through which the primary air/gas mixture is passed to the exterior of the body for combustion. Other prior art sealed burner designs include a stamped burner top which is crimped to a stamped burner base to form the sealed gas chamber. In this design, the burner top normally includes the plurality of burner ports.

A major disadvantage to these prior art designs for sealed burners has been the difficulty of the procedure required when cleaning the range and the burner assembly. The burner assemblies having a removable top allowed access to the gas chamber and burrier ports formed in the burner body but removal of the burner body for cleaning of the range normally required some type of tool to release a specific fastener securing the burner body to the range top. The stamped burner designs have been manufactured such that they are removable from the range top but the designs for the crimped assemblies have severely limited access to the gas chamber and inside portion of the burner ports for cleaning.

In addition to the cleaning problems associated with these prior art sealed burners are the problems associated with the premixing of the air and gas. Generally, the gas/air mixer tubes for these sealed burners are shorter in length in order to accommodate the shallow burner box compartments. Extending the length of these gas/air mixer tubes means increasing the size of the burner box or extending the tube in the direction of the gas valve at the front of the range top. Increasing the size of the burner box creates a packaging problem for the range top and extending the tube towards the gas valve creates assembly problems due to the difficulty encountered in attempting to maneuver a long mixer tube through a relatively small burner opening in the range top in order to properly connect the tube to the gas valve.

The present invention provides the art with a stamped metal burner assembly which is comprised of a stamped burner base and a stamped burner cap. The burner base is attached to the range top using a twist lock connection between the burner base and the range top. The twist lock feature eliminates the need for any type of tool to remove the burner base for cleaning or maintenance. The elimination of the need for the tool also eliminates the possibility of causing the enamel of the range to chip and or marring of the rang top during removal of the burner body. The burner cap which includes the plurality of burner ports engages the burner base using a fluid tight slip fit such that the burner cap can be easily removed from the burner base with its associated burner ports. The burner assembly telescopically engages an air/fuel mixer tube which extends between the gas valve and the burner opening in the range top. The mixer tube is secured to a cross support member underneath the range top by a clip that allows the air/fuel mixer tube to move sufficiently enough to properly align with the burner body during assembly and dis-assembly of the burner. This telescoping arrangement also accommodates for the typical sagging of the range top which occurs when it is hot and loaded with cooking utensils. This sagging can be accommodated for without affecting the performance of the burner from an emissions standpoint.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
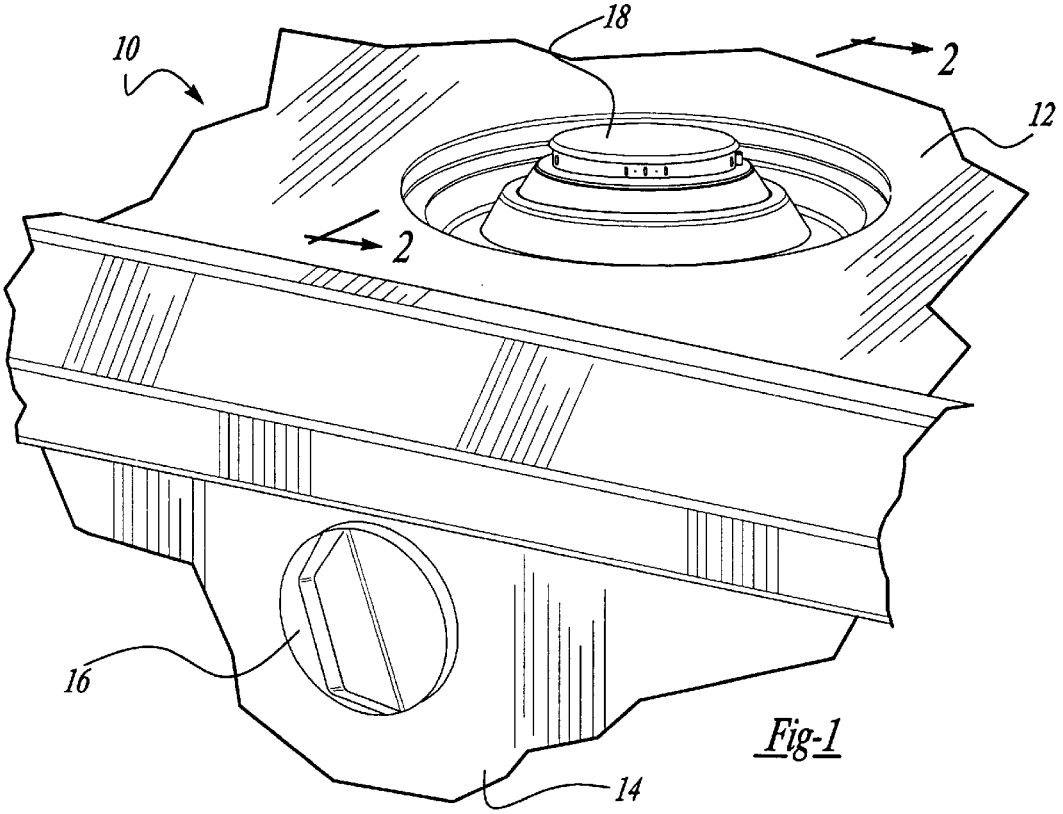
FIG. 1 is a front perspective view showing a portion of a typical range top incorporating the unique burner assembly in accordance with the present invention.
Figure 2:
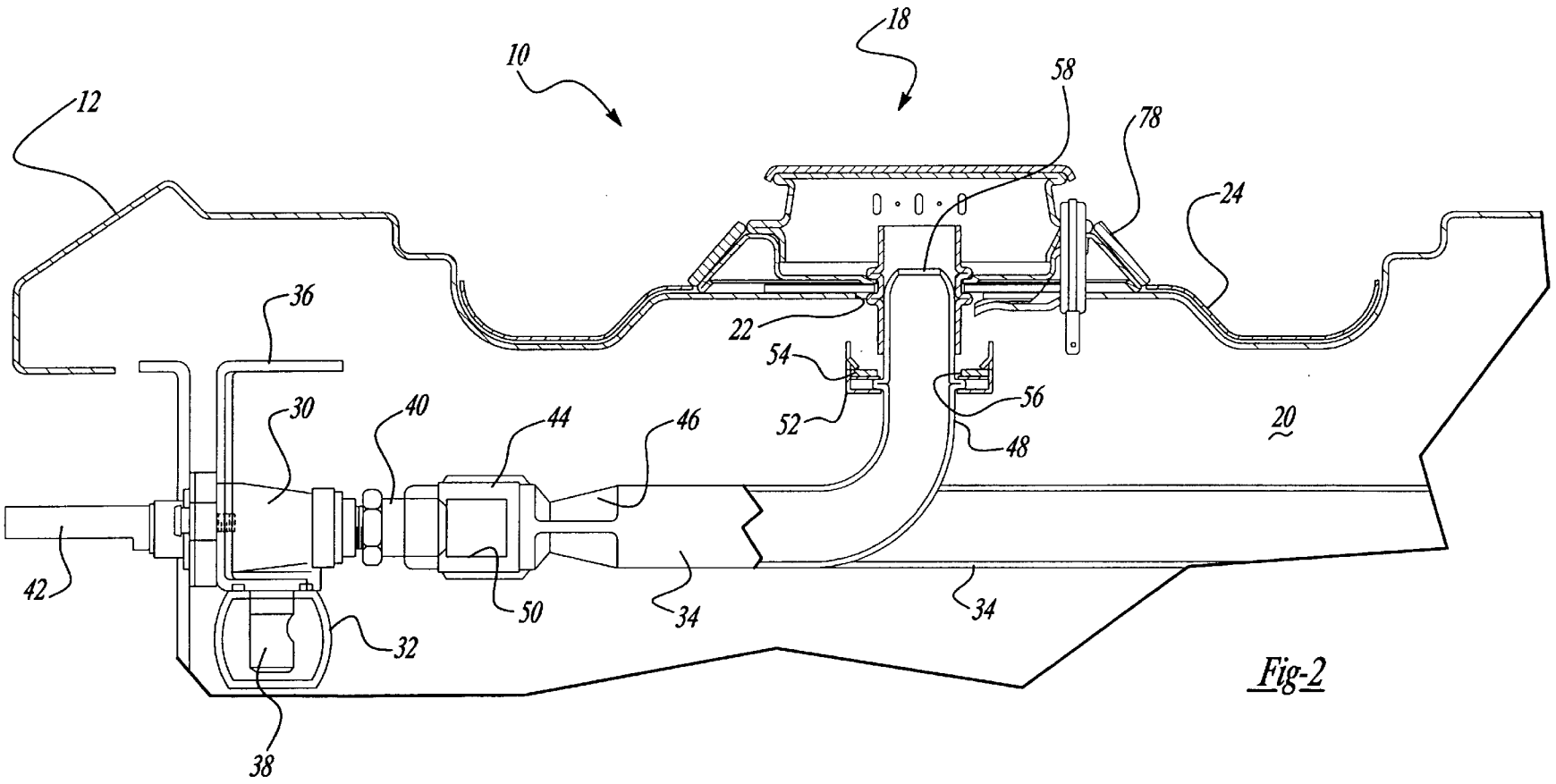
FIG. 2 is a cross-sectional view of a portion of the range top shown in FIG. 1 taken through one of the burner assemblies.

Referring now to the drawings in which like reference numerals designate like or corresponding parts throughout the several views, there is shown in FIG. 1, a portion of a range which incorporates the unique burner assembly in accordance with the present invention which is designated generally by the reference numeral 10. Range 10, which is electrically connected to an electrical ground, comprises a cook top 12, a front panel 14, a gas supply system 16 and a plurality of burner assemblies 18, only one of which is shown in FIG. 1. Cook top 12 is suitably attached to front panel 14 to accommodate the removal of cook top 12 for cleaning and/or servicing requirements. While not specifically shown, cook top 12 can be a portion of a stand alone range, a built-in range, a counter top range or any other configuration of cooking appliance. Referring now to FIG. 2, a burner box 20 is formed below cook top 12 and behind front panel 14 to accommodate gas supply system 16. Cook top 12 defines a plurality of apertures 22 within each of which is disposed respective burner assembly 18 releasably secure to cook top 12. A plurality of removable drip pans 24 may be positioned around each burner assembly 18 to simplify the required cleaning if desired.

Figure 3:
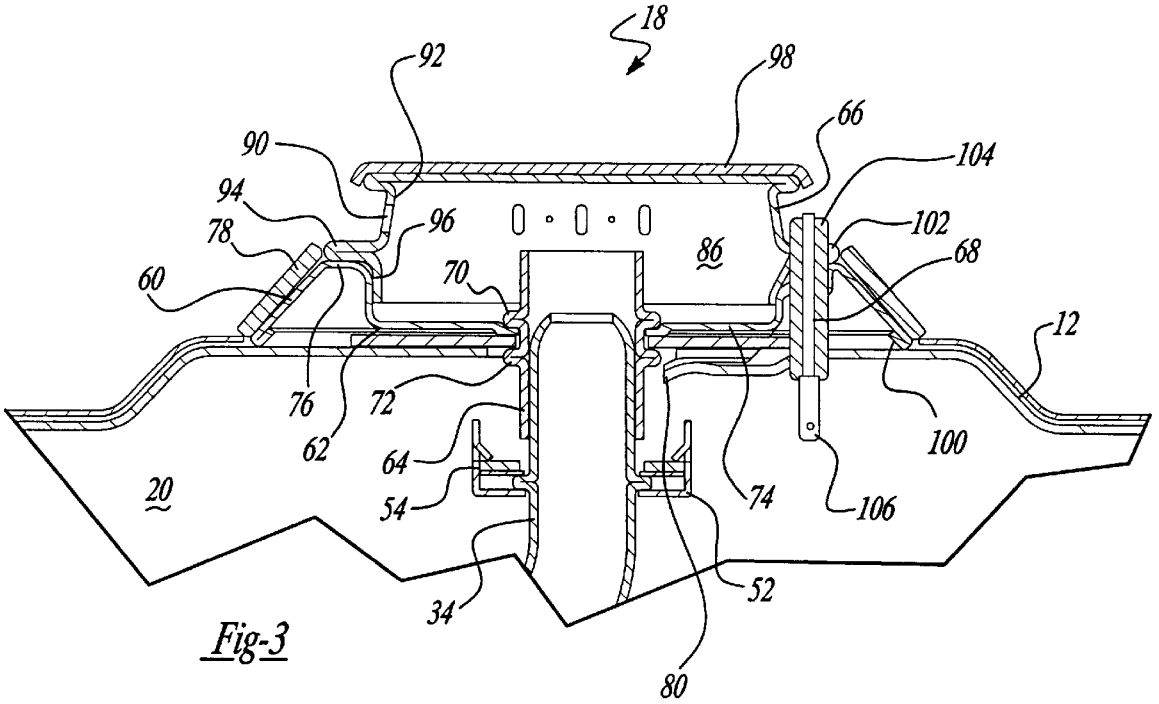
FIG. 3 is an enlarged cross-sectional view through the range top and burner assembly shown in FIG. 2.

Referring now to FIGS. 2 and 3, gas supply system 16 comprises a plurality of gas valves 30, a gas manifold 32 and a plurality of air/fuel mixing tubes 34. Each burner assembly 18 is associated with a respective gas valve 30 and a respective air/fuel mixing tube 34. FIGS. 2 and 3 illustrate one of the plurality of burner assemblies similar to what is shown in FIG. 1. Gas valve 30 is secured to a bracket 36 which is secured to the inner structure of range 10. Gas valve 30 includes an inlet 38 extending into gas manifold 32, an outlet 40 mating with mixing tube 34 and a valve stem 42 extending into a user accessible location to allow an individual to control the amount of gas flowing between inlet 38 and outlet 40. Gas manifold 32 is fixedly secured with respect to gas valve 30 and is connected to a source of fuel gas (not shown). Thus manifold 32 interconnects the source of fuel gas with each gas valve 30 in gas supply system 16.

Air/fuel mixing tube 34 extends between gas valve 30 and a respective aperture 22 to supply an air/fuel premix to a respective burner assembly 18. Air/fuel mixing tube 34 is a generally L-shaped tube having an air/fuel mixing section 44, a venturi section 46 and a delivery tube 48. Air/fuel mixing section 44 mates with outlet 40 and defines a pair of apertures 50 which provide for air intake. The air/fuel mixture passes through venturi section 46 and is subsequently delivered to burner assembly 18 by delivery tube 48. The end of delivery tube 48 which is adjacent to burner assembly 18 is mounted to a bracket 52 which is attached to the inner structure of range 10 by a snap ring 54. Snap ring 54 includes an inner diameter 56 which is larger than the outside diameter of delivery tube 48 to allow for a limited movement of air/fuel mixing tube 34 to properly align with burner assembly 18. Thus, air/fuel mixing tube 34 is located and secured within burner box 20 by the attachment of air/fuel mixing section 44 with outlet 40 and the attachment of delivery tube 48 to bracket 52. The burner assembly end of delivery tube 48 defines an aperture 58 which delivers the air/fuel premix to burner assembly 18.

Burner assembly 18 comprises a burner base 60, an attachment plate 62, a gas tube 64, a burner cap 66 and a ignitor assembly 68. Burner base 60 and attachment plate 62 are secured together by an upper crimp 70 and a lower crimp 72 formed in gas tube 64. Burner base 60 includes a generally flat base 74 which forms a skirted section 76 at its periphery. Skirted section 76 provides a contoured interface with cook top 12 and may be covered with a removable decorative skirt 78 if desired.

Gas tube 64 is designed to telescopically engage delivery tube 48 of air/fuel mixing tube 34 and extends between mixing tube 34 and a gas chamber 86 formed by burner cap 66 and burner base 60. As stated above, air/fuel mixing tube 34 is mounted to bracket 52 by snap ring 54 which permits a small amount of movement of air/fuel mixing tube 34 for alignment purposes when tabs 80 mate with fingers 82.

Figure 4:
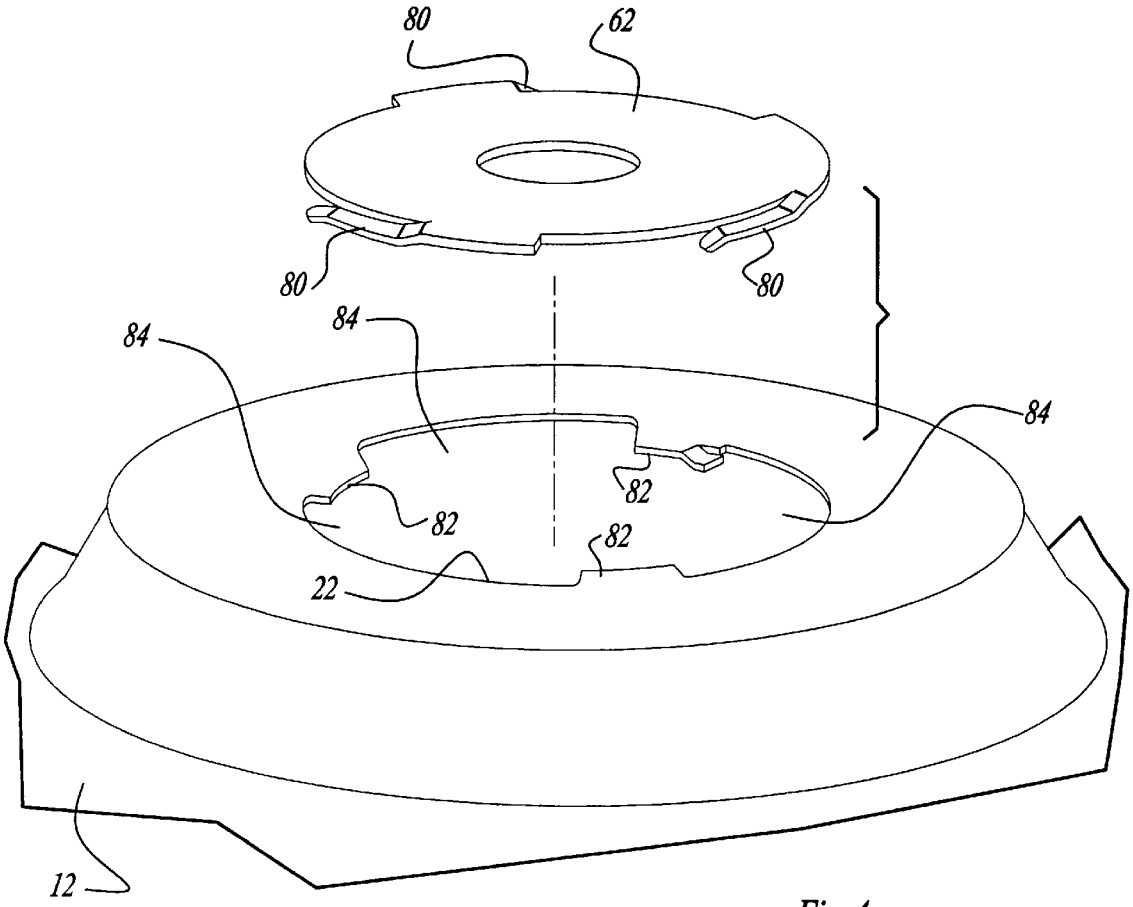
FIG. 4 is an exploded perspective view of the twist lock attachment of the burner assembly to a portion of the range top shown in FIGS. 1–3.

Attachment plate 62, shown in FIG. 4, defines three tabs 80 which are formed out of the plate and extend generally parallel to plate 62. Each range top aperture 22 is shaped to define three fingers 82 each of which is positioned to mate with a respective tab 80. Burner base 60, attachment plate 62 and gas tube 64 are assembled to cook top 12 by first aligning tabs 80 with the cut out areas 84 of aperture 22 positioned between adjacent fingers 82 while simultaneously positioning gas tube 64 over air/fuel mixing tube 34. One cut out area 84 between adjacent fingers 82 is enlarged to accommodate ignitor assembly 68 during the assembly. Once tabs 80 are inserted into cut out areas 84, burner base 60, attachment plate 62 and gas tube 64 are rotated to engage tabs 80 with the underside of fingers 82 securing the assembly to cook top 12. In order to facilitate the engagement of tabs 80 with fingers 82, the ends of tabs 80 can be bent downward as shown in FIG. 4.

Burner cap 66 defines a plurality of burner ports 90 extending through a side wall 92. Burner cap 66 further defines a flange 94 which mates with skirted section 76 when burner cap 66 is assembled to burner base 60 and an annular sleeve 96 which engages burner base 60 to form a seal for gas chamber 86. A removable decorative cover 98 may be assembled to burner cap 66 if desired. Burner cap 66 is connected to electrical ground through burner base 60, attachment plate 62 and cook top 12. Ignitor assembly 68 is located outwardly of attachment plate 62 and extends through an aperture 100 in burner base 60 and through a slot 102 defined by burner cap 66 to a position adjacent the top of burner cap 66. Ignitor assembly 68 comprises an insulator 104 and an electrode 106. Electrode 106 is connected to an appropriate electrical circuit (not shown) for providing a spark between electrode 106 and burner cap 66 for igniting the air/fuel mixture flowing through burner ports 90.

The operation of range 10 begins by having an individual rotate valve stem 42 which opens gas valve 30 to allow fuel gas to flow from manifold 32 through gas valve 30 and through air/fuel mixing tube 34 to enter gas chamber 86. Air entering through apertures 50 mixes with the fuel as it passes through venturi 46 on its way to gas chamber 86. The air/fuel mixture flows through burner ports 90 and ignition of the mixture begins by having ignitor assembly 68 creating a spark between electrode 106 and burner cap 66.

The cleaning of the burner assembly can be done simply and easily without the need for special tools. In order to clean burner ports 90, burner cap 66 is removed and washed with complete access being available to both sides of burner ports 90. Decorative lid 98 can also be removed and cleaned with or without the removal of burner cap 66. When the entire cook top 12 is to be cleaned, decorative cover 98 can be removed, decorative skirt 78 can be removed, drip pan 24 can be removed and burner cap 66 can be removed. Burner base 60 can then be rotated to disengage tabs 80 from fingers 82 and the remainder of burner assembly 18 can be removed. An electrical connector is then disconnected from ignitor assembly 68 to separate burner assembly 18 from cook top 12. Once all of burner assemblies 18 have been removed, cook top 12 is entirely open for cleaning and/or removal from range 10 to obtain access to burner box 20. Assembly of cook top 12 and/or range 10 is accomplished by reversing the disassembly process.

While the above detailed description describes the preferred embodiment of the present invention, it should be understood that the present invention is susceptible to modification, variation and alteration without deviating from the scope and fair meaning of the subjoined claims.

What is claimed is:

1. A gas burner assembly for a cook top, said gas burner assembly comprising:

a base section having a generally consistent wall thickness;

a burner cap having a generally consistent wall thickness, said burner cap defining a plurality of burner ports, said burner cap being releasably secured to said base section to form a gas chamber; and an attachment plate secured to said base section, said attachment plate adapted to secure said gas burner assembly to said cook top.

2. The gas burner assembly according to claim 1 wherein, said burner cap includes an annular sleeve, said annular sleeve engaging said base section to form a seal for said gas chamber.

3. The gas burner assembly according to claim 1 wherein, said attachment plate includes a tab for engaging said cook top.

4. The gas burner assembly according to claim 1 further comprising a gas tube extending through said base section and said attachment plate, said gas tube securing said attachment plate to said base section.

5. The gas burner assembly according to claim 1 further comprising an ignitor assembly extending through said base section and said burner cap.

6. The gas burner assembly according to claim 5 wherein, said ignitor assembly includes an electrode, said electrode being disposed adjacent to an exterior surface of said burner cap.

7. The gas burner assembly according to claim 1 wherein, said burner cap defines a flange, said flange engaging said base section when said burner cap is secured to said base section.

8. The gas burner assembly according to claim 7 wherein, said burner cap includes an annular sleeve, said annular sleeve engaging said base section to form a seal for said gas chamber.

9. A gas burner assembly for a cook top, said gas burner assembly having a gas chamber, a gas inlet for providing fuel to said gas chamber and a plurality of burner ports for providing fuel from said gas chamber, said gas burner assembly comprising:

a cup-shaped base section having a generally consistent wall thickness, said base section forming a portion of said gas chamber;

a cup-shaped burner cap having a generally consistent wall thickness, said burner cap defining said plurality of burner ports, said burner cap being releasably secured to said base section to form a second portion of said gas chamber; and an attachment plate secured to said base section, said attachment plate adapted to secure said gas burner assembly to said cook top.

10. The gas burner assembly according to claim 9 wherein, said burner cap includes an annular sleeve, said annular sleeve engaging said base section to form a seal for said gas chamber.

11. The gas burner assembly according to claim 9 further comprising an ignitor assembly extending through said base section and said burner cap.

12. The gas burner assembly according to claim 11 wherein, said ignitor assembly includes an electrode, said electrode being disposed adjacent to an exterior surface of said burner cap.

13. The gas burner assembly according to claim 9 wherein, said burner cap defines a flange, said flange engaging said base section when said burner cap is secured to said base section.

14. The gas burner assembly according to claim 13 wherein, said burner cap includes an annular sleeve, said annular sleeve engaging said base section to form a seal for said gas chamber.

15. A gas range comprising:

a cook top defining at least one burner aperture;

a gas burner assembly disposed within said at least one burner aperture, said gas burner assembly comprising a base section having a generally consistent wall thickness, a burner cap having a generally consistent wall thickness, said burner cap defining a plurality of burner ports, said burner cap being releasably secured to said base section to form a gas chamber an attachment plate secured to said base section, said attachment plate adapted to secure said gas burner to said cook top;

a gas valve fixedly secured to said gas range;

an air/fuel mixing tube disposed between said gas valve and said gas burner assembly, said air/fuel mixing tube providing fluid communication between said gas valve and said gas chamber, said air/fuel mixing tube telescopingly engaging said gas burner assembly.

16. The gas range according to claim 15 wherein, said air/fuel mixing tube comprises an air/fuel mixing section, a venturi section and a delivery tube.

17. The gas range according to claim 16 wherein, said burner cap includes an annular sleeve, said annular sleeve engaging said base section to form a seal for said gas chamber.

18. The gas burner assembly according to claim 15 wherein, said attachment plate includes a tab for engaging said cook top.

19. The gas range according to claim 18 wherein, said at least one burner aperture defines a finger, said tab engaging said finger to secure said burner assembly to said cook top.

20. The gas burner assembly according to claim 15 further comprising a gas tube extending through said base section and said attachment plate, said gas tube securing said attachment plate to said base section, said air/fuel mixing tube telescopingly engaging said gas tube.

21. The gas burner assembly according to claim 16 further comprising an ignitor assembly extending through said base section and said burner cap.

22. The gas burner assembly according to claim 21 wherein, said ignitor assembly includes an electrode, said electrode being disposed adjacent to an exterior surface of said burner cap.

23. The gas burner assembly according to claim 16 wherein, said burner cap defines a flange, said flange engaging said base section when said burner cap is secured to said base section.

24. The gas burner assembly according to claim 23 wherein, said burner cap includes an annular sleeve, said annular sleeve engaging said base section to form a seal for said gas chamber.

25. A gas burner assembly for a cook top, said gas burner assembly comprising:

a base section having a generally consistent wall thickness adapted to be secured to said cook top;

a burner cap having a generally consistent wall thickness, said burner cap defining a plurality of burner ports, said burner cap being removable from said base section while said base section is secured to said cook top; and an attachment plate secured to said base section, said attachment plate adapted to secure said gas burner assembly to said cook top.

26. A gas burner assembly for a cook top, said gas burner assembly comprising:

a base section having a generally consistent wall thickness;

a burner cap having a generally consistent wall thickness, said burner cap defining a plurality of burner ports, said burner cap being releasably secured to said base section to form a gas chamber; and an ignitor assembly being secured to said base section and extending through said base section and said burner cap; said burner cap removable from said base section without disturbing said igniter assembly.

27. A gas burner assembly for a cook top, said gas burner assembly having a gas chamber, a gas inlet for providing fuel to said gas chamber and a plurality of burner ports for providing fuel from said gas chamber, said gas burner assembly comprising:

a cup-shaped base section having a generally consistent wall thickness, said base section forming a portion of said gas chamber;

a cup-shaped burner cap having a generally consistent wall thickness, said burner cap defining said plurality of burner ports, said burner cap being releasably secured to said base section to form a second portion of said gas chamber; and an ignitor assembly being secured to said base section extending through said base section and said burner cap; said burner cap being removable from said base section without disturbing said igniter assembly.

* * * * *

UNITED STATES PATENT AND TRADEMARK OFFICE

CERTIFICATE OF CORRECTION

PATENT NO. : 5,865,615

DATED : February 2, 1999

INVENTOR(S) : Anthony W. Simpson, et al.

It is certified that error appears in the above-identified patent and that said Letters Patent is hereby corrected as shown below:

Column 5, line 62, the "," should read --and--.

Column 5, line 65, after "chamber" insert --,--.

Column 6, line 15, delete "burner assembly" and insert --range--.

Column 6, line 16, after "wherein" delete ",".

Column 6, line 21, delete "burner assembly" and insert --range--.

Column 6, line 26, delete "burner assembly" and insert --range--.

Column 6, line 29, delete "burner assembly" and insert --range--.

Column 6, line 30, after "wherein" delete ",".

Column 6, line 33, delete "burner assembly" and insert --range--.

Column 6, line 34, after "wherein" delete ",".

UNITED STATES PATENT AND TRADEMARK OFFICE

CERTIFICATE OF CORRECTION

PATENT NO. : 5,865,615

DATED : February 2, 1999

INVENTOR(S) : Anthony W. Simpson, et al.

It is certified that error appears in the above-identified patent and that said Letters Patent is hereby corrected as shown below:

Column 6, line 37, delete "burner assembly" and insert --range--.

Column 6, line 38, after "wherein" delete ",".

Column 6, line 61, after "assembly" delete "being".

Column 8, line 3, after "assembly" delete "being".

Signed and Sealed this

Twenty-third Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,865,615

DATED : February 2, 1999

INVENTOR(S) : Anthony W. Simpson et al

It is certified that error appears in the above-identified patent and that said Letters Patent is hereby corrected as shown below:

Column 1, line 43, "burrier" should be -- burner --.

Column 2, line 7, "rang" should be -- range --.

Column 2, line 41, ";" should be -- . --.

Column 3, line 39, "a" (third occurrence) should be -- an --.

Column 5, line 67, after "burner" insert -- assembly --.

Column 6, line 40, "chamber" should be -- burner --.

Column 6, line 63, begin new paragraph with "said" (first occurence).

Column 6, line 63, after "cap" insert -- being --.

UNITED STATES PATENT AND TRADEMARK OFFICE

CERTIFICATE OF CORRECTION

PATENT NO. : 5,865,615

DATED : February 2, 1999

INVENTOR(S) : Anthony W. Simpson et al

It is certified that error appears in the above-identified patent and that said Letters Patent is hereby corrected as shown below:

Column 6, line 64, "igniter" should be -- ignitor --.

Column 8, line 3, after "section" insert -- and --.

Column 8, line 5, begin new paragraph with "said" (first occurrence).

Column 8, line 6, "igniter" should be -- ignitor --.

Signed and Sealed this

Thirtieth Day of November, 1999

*Attest:*

*Attesting Officer*

Q. TODD DICKINSON

*Acting Commissioner of Patents and Trademarks*